US008474793B2

(12) United States Patent
Penenburgh

(10) Patent No.: US 8,474,793 B2
(45) Date of Patent: Jul. 2, 2013

(54) LIFTING SYSTEM

(75) Inventor: Robert Penenburgh, Manassas, VA (US)

(73) Assignee: Automotive Resource, Inc., Manassas, VA (US)

( * ) Notice: Subject to any disclaimer, the term of this patent is extended or adjusted under 35 U.S.C. 154(b) by 259 days.

(21) Appl. No.: 12/902,568

(22) Filed: Oct. 12, 2010

(65) Prior Publication Data

US 2011/0084245 A1 Apr. 14, 2011

Related U.S. Application Data

(60) Provisional application No. 61/250,252, filed on Oct. 9, 2009.

(51) Int. Cl.
*B66F 5/00* (2006.01)
*B66F 3/00* (2006.01)

(52) U.S. Cl.
USPC ..... 254/2 B; 254/134; 254/2 R; 269/17

(58) Field of Classification Search
USPC ..... 254/2 R, 2 B, 134, 7 R, 7 B, 89 R, 254/89 H; 180/19.3; 414/458, 495; 269/17; 187/234
See application file for complete search history.

(56) References Cited

U.S. PATENT DOCUMENTS

| | | | | |
|---|---|---|---|---|
| 2,256,314 | A * | 9/1941 | Dunham | 180/54.1 |
| 4,034,878 | A * | 7/1977 | Fox | 414/448 |
| 5,595,265 | A * | 1/1997 | Lebrocquy | 187/261 |
| 5,885,048 | A * | 3/1999 | Barth | 414/495 |
| 2002/0195593 | A1 * | 12/2002 | Ardrey et al. | 254/100 |
| 2011/0084245 | A1 * | 4/2011 | Penenburgh | 254/2 R |

* cited by examiner

*Primary Examiner* — Lee D Wilson
(74) *Attorney, Agent, or Firm* — Mark S. Leonardo; Brown Rudnick LLP

(57) ABSTRACT

The invention provides a lifting system that decreases the amount of energy used while lifting luggage from the ground in a variety of locations. According to the invention, a lifting system operates on a regenerative braking mechanism that provides for recharging the battery of the lifting system using energy created from rotational force generated by the lowering of an arm of the lifting system.

9 Claims, 5 Drawing Sheets

LIFTING SYSTEM

BACKGROUND OF THE INVENTION

1. Field of the Invention

The present invention relates to a lifting system, and more specifically, a hybrid lifting system with regenerative braking.

2. Description of the Related Art

It is frequently necessary to lift luggage, parcels, vehicles and/or other machines from the ground to perform service, inspect or otherwise move a vehicle or machine from the ground. In the past, this lifting has been accomplished with built-in systems at service facilities. These built-in systems are very expensive and are inconvenient as these systems cannot be moved. To remedy this, mobile lift columns were created to provide easily moveable lift columns that could lift vehicles or machines from the ground in a variety of locations.

The lifting systems currently available require a tremendous amount of energy to lift vehicles and provide no means of recharging with the exception of connecting the system to an energy supply. Therefore, what is needed is a regenerative lifting system that provides a means for recharging using energy created from lowering a vehicle or machine. The present invention fulfills this need.

SUMMARY OF THE INVENTION

In one aspect according to the invention, the invention relates to a lifting system that includes a base, an upstanding post operatively connected to the base, a lifting carriage slidably coupled to the upstanding post, and a regenerative braking system to recharge at least one battery.

In one embodiment according to this aspect of the invention, the regenerative braking system uses rotational force of a motor to generate electricity to back feed the battery.

In another embodiment according to this aspect of the invention, the regenerative braking system comprises a motor that is used to drive a worm screw.

In another embodiment according to this aspect of the invention, the lifting system further comprises a mechanism that indicates unsafe operations. The unsafe operation may include overweight luggage, excessive speed limit of the lifting system, excessive speed limit of the lifting carriage, excessive temperature of the motor, and sticking of the lower limit switch.

In another embodiment according to this aspect of the invention, the lifting system further includes a microprocessor that determines the functionality of the lifting system and communicates with other lifting systems being utilized.

In another embodiment according to this aspect of the invention, the lifting system is mobile.

In a second embodiment of the invention, the invention relates to a regenerative braking lifting system including a base configured for mobility, at least one wheel rotatably coupled to the base, an upstanding post that is operatively connected to the base, a lifting carriage that is slidably coupled to the upstanding post, a housing operatively connected to the lifting system, wherein the housing comprises at least one battery, a charger, and a circuitry of the lifting system, and a motor operatively connected to the housing, where rotational force of the motor generates electricity to feed back to the battery.

In one embodiment according to this aspect of the invention, the motor is a three phase induction motor used to drive a worm screw.

In another embodiment according to this aspect of the invention, the lifting system further comprises an AC three phase 24V motor and a geared transmission operatively connected to a worm screw.

In another embodiment according to this aspect of the invention, the lifting system further comprises a mechanism that indicates unsafe operations. The unsafe operation may include overweight luggage, excessive speed limit of the lifting system, excessive speed limit of the lifting carriage, excessive temperature of the motor, and sticking of the lower limit switch.

In another embodiment according to this aspect of the invention, the lifting system further comprises a microprocessor that determines the functionality of the lifting system and communicates with other lifting systems being utilized.

In a third embodiment of the invention, the invention relates to a method of operating a lifting system by means of a regenerative braking system including utilizing a lifting system, such as a lifting system described above, operating the lifting carriage in an upward direction, wherein the battery drives the motor to move the lifting arm upwardly, and operating the lifting carriage in a downward direction, wherein the motor rotates by means of mechanical force caused by the weight of a luggage on the lifting arm and wherein a rotational force generates electric feedback to the battery of the lifting system.

In one embodiment according to this aspect of the invention, the lifting system operates in a single mode system.

In another embodiment according to this aspect of the invention, the lifting system operates in a multi mode system.

DETAILED DESCRIPTION OF THE INVENTION

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

The present invention, a lifting system, is comprised of: a base; an upstanding post; a lifting carriage; a battery, a charger and/or circuitry; and a motor configured to raise and lower a vehicle or other machine. It will be understood and appreciated that the lifting system according to the present disclosure can be used to lift a variety of vehicles or other large machines or devices. It is further understood that one or more of the lifting systems may be used as appropriate to lift for any sort of luggage, such as, for example, a vehicle, a machine, a parcel, and a receptacle.

The following discussion includes a description of the lifting system and related components in accordance with the principles of the present disclosure. Reference will now be made in detail to the exemplary embodiments of the present disclosure, which are illustrated in the accompanying figures.

Figure 1:
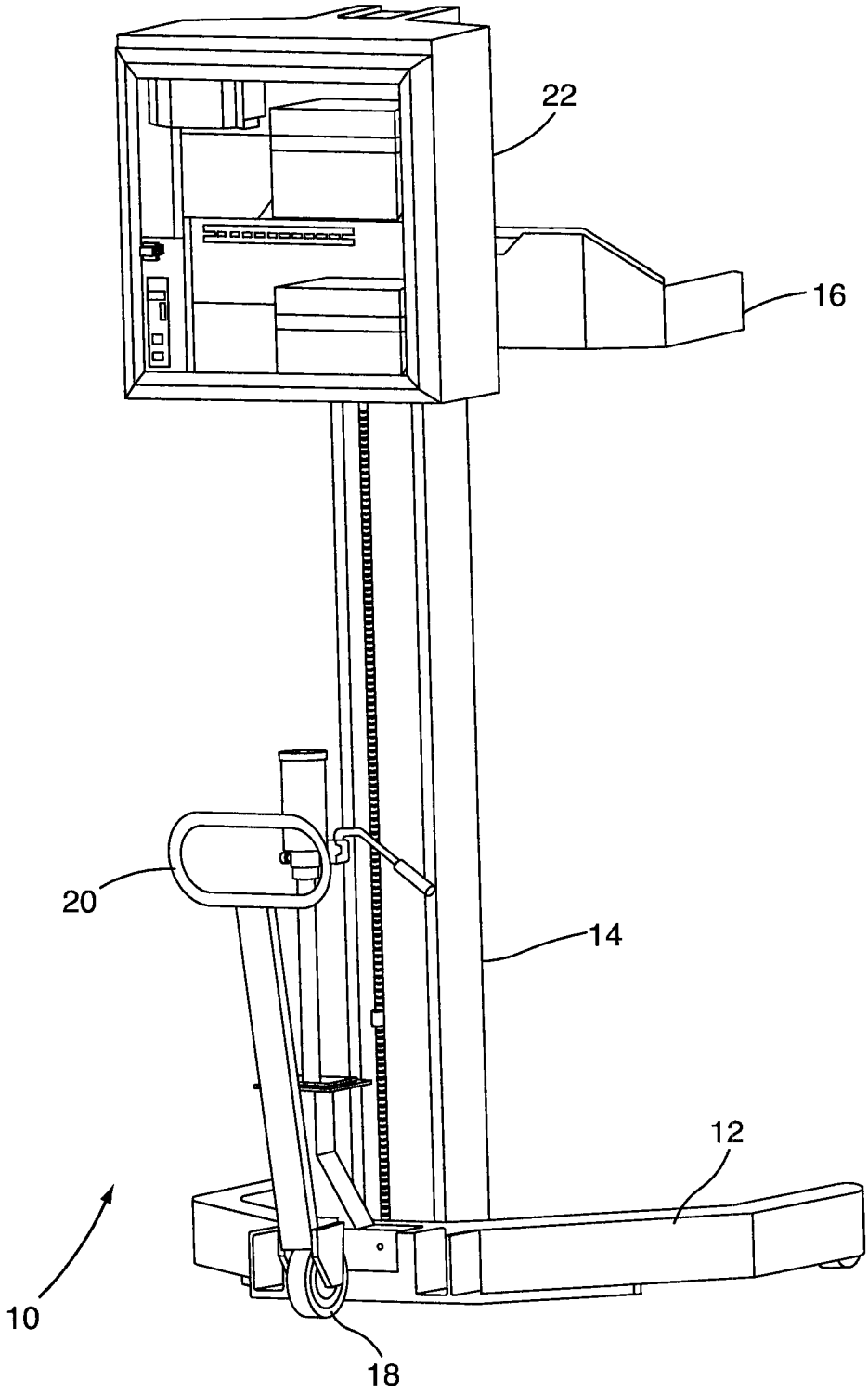
FIG. 1 is a perspective view of the lifting system in accordance with the present disclosure.

Turning now to FIG. 1, there is illustrated a lifting system 10, in accordance with the principles of the present disclosure. Lifting system 10 includes a base 12 to provide support for lifting system 10. Base 12 is operatively connected to an upstanding post 14, which has a lifting carriage 16 slidably coupled to upstanding post 14. Lifting carriage 16 is typically connected to upstanding post 14 via a ball screw with guiding wheels along a machined surface. At least one wheel 18 and a handle 20 can be connected to base 12 to allow lifting system 10 to be moved as necessary. Lifting system 10 further includes a housing 22. Housing 22 houses at least one battery, a charger and circuitry of lifting system 10.

Figure 2:
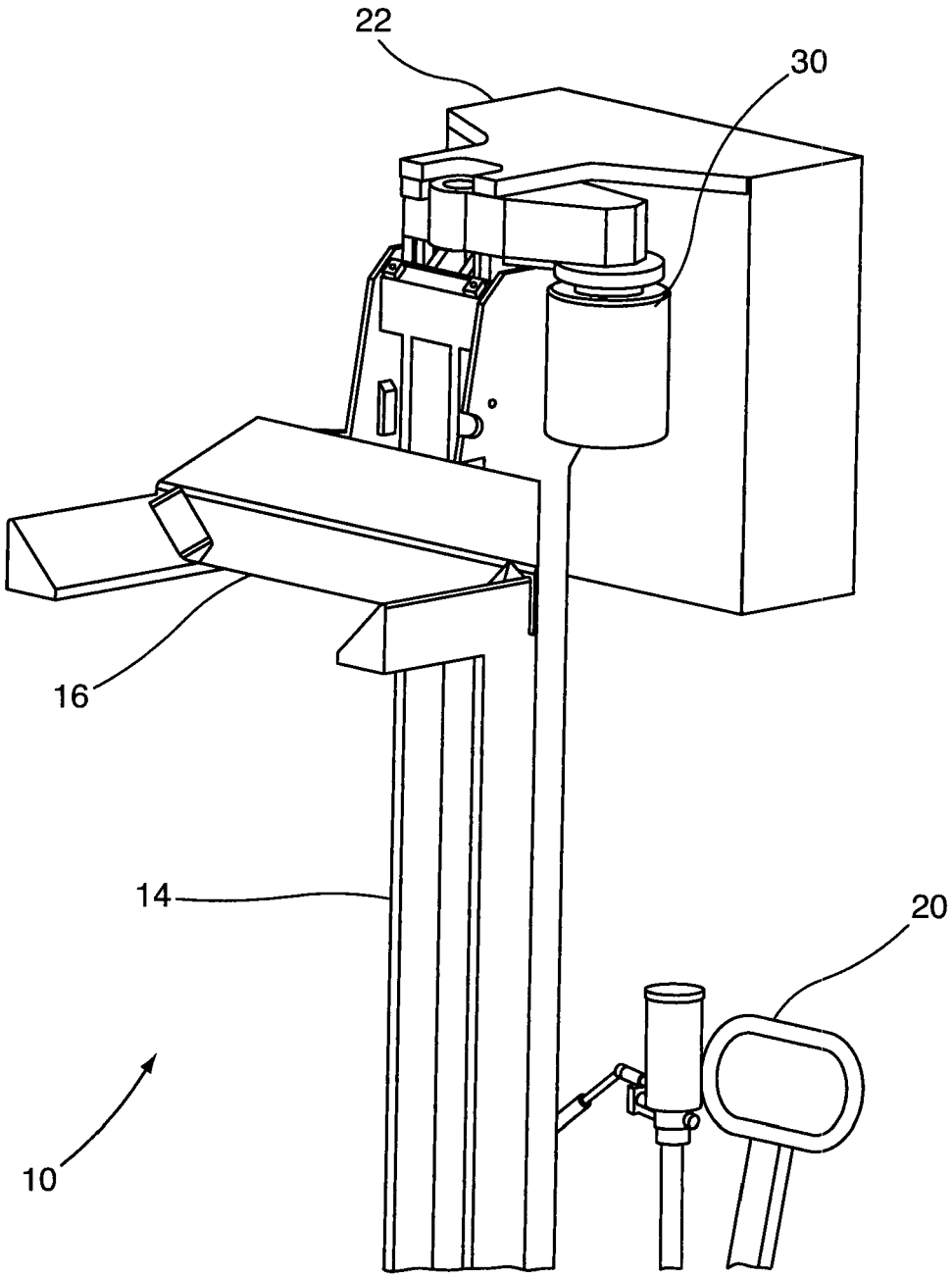
FIG. 2 is a back perspective view of the lifting system in accordance with the present disclosure.
Figure 3:
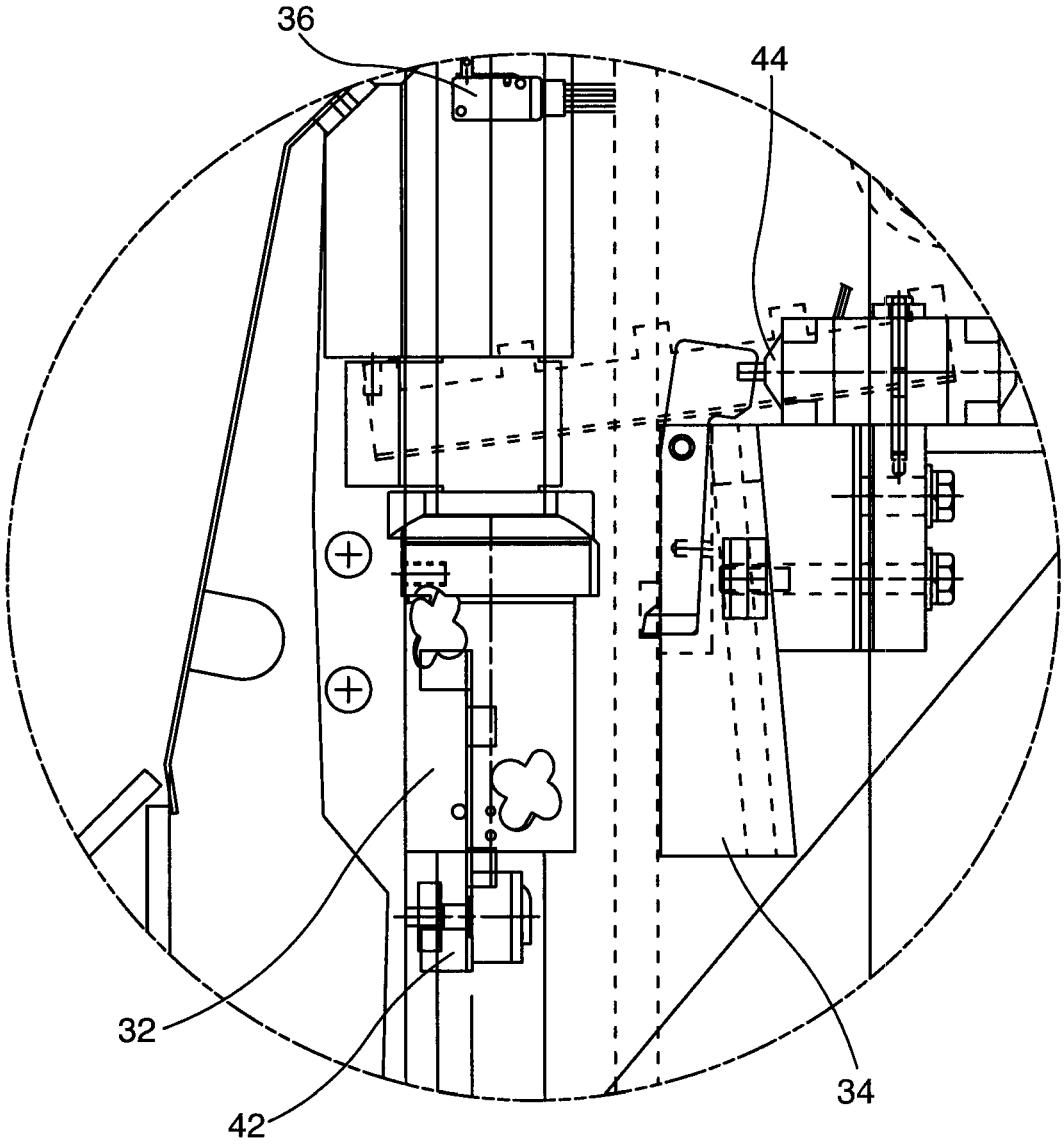
FIG. 3 is a schematic of the regenerative braking system in accordance with the present disclosure.

Now referring to FIG. 2 and FIG. 3, a motor 30 is depicted. Motor 30 can be a three (3) phase induction motor used to drive a worm screw, which is configured to be a regenerative braking system. A ball nut 32 located on the worm screw, connected to a lifting carriage is used to raise and lower vehicles. Motor 30 and a transmission can generally be a AC three (3) phase 24V motor and geared transmission connected to the worm screw. In the upward direction, the motor is driven by at least one battery, by way of an induction motor controller. On the downward direction, the motor is allowed to rotate by means of mechanical force caused by the weight of the vehicle. This rotational force is used to generate electricity to back feed the battery. This motor generally will include a brake mechanism that must be engaged to allow the lift to move. Batteries typically used are wet cell, group 24 size designation with no less than 550 cold cranking AMPs.

FIG. 3 depicts a schematic of the regenerative braking system in accordance with the present disclosure. The ball nut 32 (5 race ball nut with ninety (90) ball bearings and grease zerk fitting) and a lock wedge (machined steel lock wedge with corrosion resistant coating) are depicted in FIG. 3. Limit switches 36 check the carriage motion at the top and bottom of lift. Limit switches can be spark resistant. A motion sensor 42 tracks travel height and communicates it back with the micro processor unit. A lock wedge solenoid 44 is a 24 V solenoid that opens and closes a finger that disengages the lock wedge. If the finger has not disengaged the lock wedge it will firmly hold the carriage to the post in a locked position. The ball screw is a precision rolled ball screw that rotates to spin motor that produces electricity back to the battery.

Figure 4:
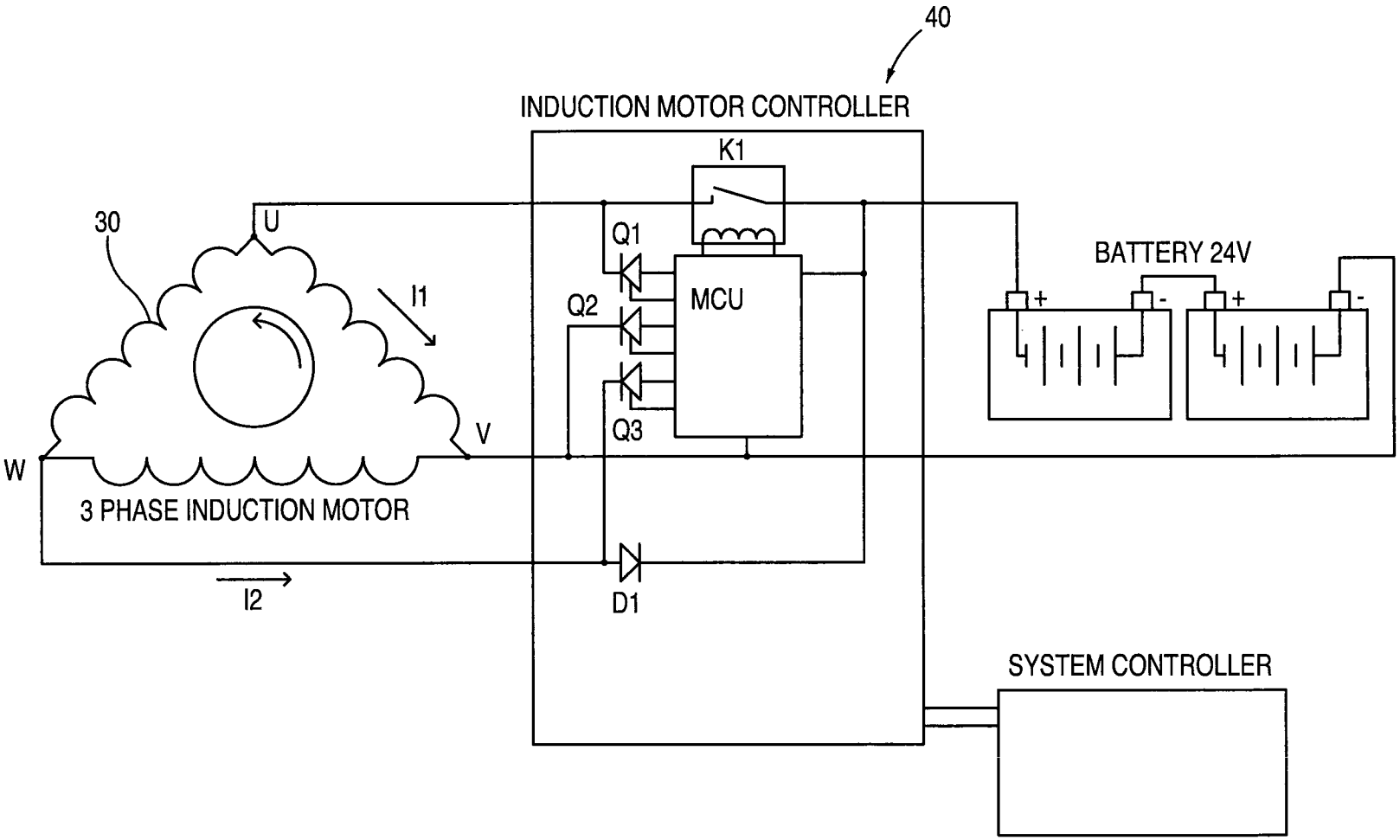
FIG. 4 is schematic diagram of the motor and battery configuration in accordance with the present disclosure.

As depicted in FIG. 4, an induction motor controller 40 applies a voltage across winding U-V by a closing relay K1. As the motor spins electromagnetic energy is transferred to windings U-W and W-V and passed through a Diode D1. This voltage is greater than the voltage being supplied by the battery so back feeding to the battery occurs. The induction motor controller applies a voltage across winding U-V by closing relay K1. As the motor spins electromagnetic energy is transferred to windings U-W and W-V and passed through Diode D1. This is based on the principal of electromagnetic energy transfer as discovered by Michael Faraday in 1831 and is used in various electrical voltage generating equipment including hydroelectric, alternators in autos, and auto regenerative braking systems. Electromagnetic energy conversion relates the electric and magnetic forces of the atom to mechanical force applied to matter and motion. Because the voltage that is generated is greater than the voltage being supplied by the battery, a back feeding to the battery occurs. Thus the mechanical energy caused by the weight of the vehicle turning the ball screw and thus turning the motor is converted to electrical energy and stored in the battery.

Figure 5:
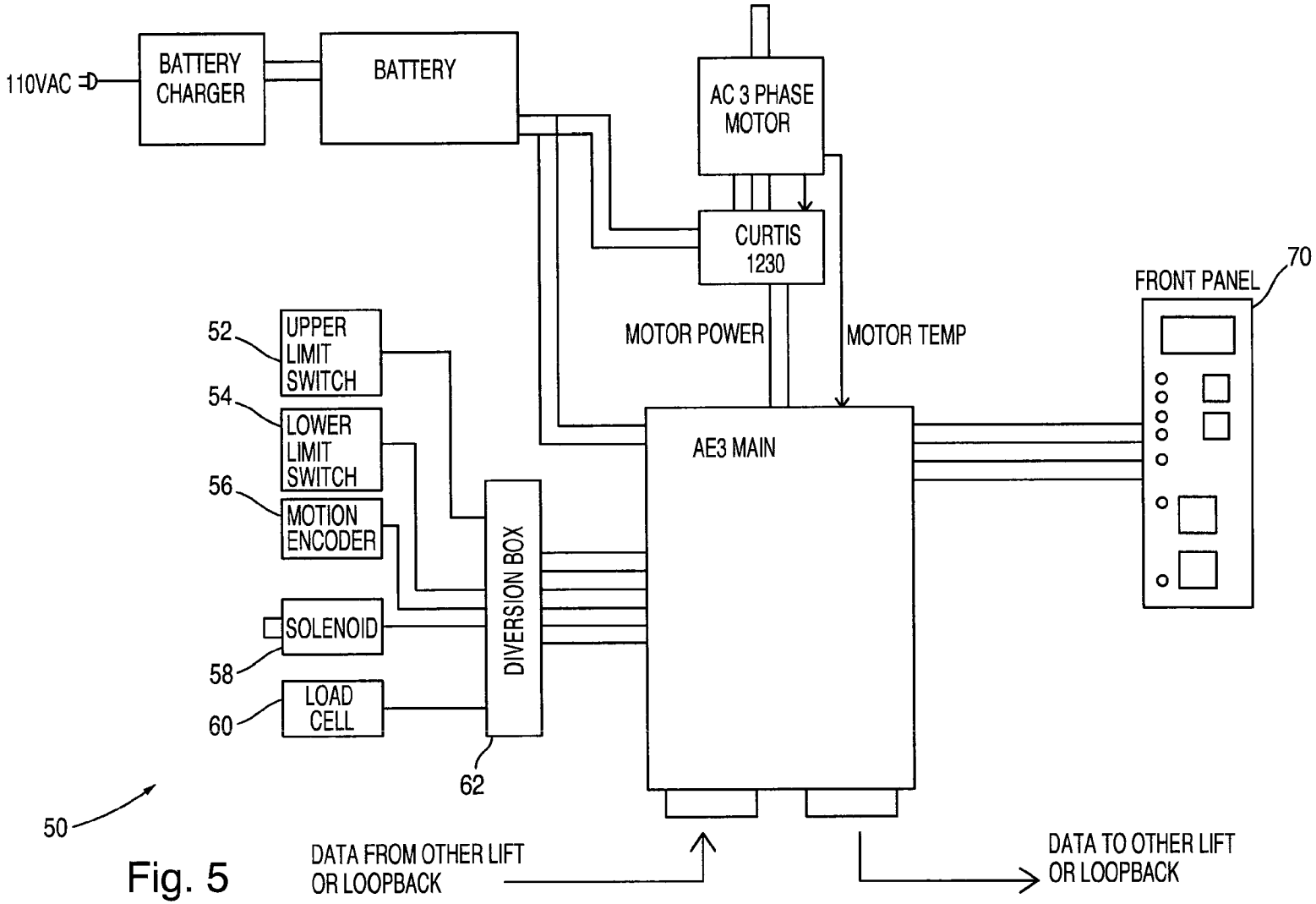
FIG. 5 is a schematic of the circuitry and controls of the lifting system in accordance with the present disclosure.

Now, referring to FIG. 5, which depicts an embodiment of the circuitry and system controls 50 of lifting system 10. A upper limit switch 52, a lower limit switch 54, a motion encoder 56, a wedge finger solenoid 58, and a load cell 60 are operatively connected to diversion box 62. Upper limit switch 52 consists of a single switch that will open when the lift reaches the top. The upper limit switch 52 is normally closed during operation and opens when the lifting carriage reaches the top of the lifting system to indicate to the lifting system to stop all upward movement on the local lift. Lower limit switch 54 is also normally closed during operation and opens when the lifting carriage reaches the bottom of the lifting system to indicate to the lifting system to stop all downward movement on the local lift.

Motion encoder 56 uses, for example, the dual channel Rotoset encoder that is used on the current AE. This device runs on a toothed track inside the lift system and can travel the entire length of lifting system 10. It outputs two channels of encoded pulses with movement that allow for detection of travel direction. The output is in the pattern of 00, 01, 10, 11, 00 . . . . The rate of travel is generally approximately 40 pulses per second. This is used to determine inappropriate movement of the lifting carriage with respect to the lifting system. Options include providing voltage and an interface for an optical dual channel encoder.

Load cell 60 is used to measure the weight placed on the lifting carriage with respect to the lifting system. Load cell's 60 main purpose is to trigger a fault condition when the lifted weight exceeds 10% +/−5% of rated capacity. Load cell 60 is also used to calculate the weight displayed on the front panel display. The display will be an averaged rock solid display. The wedge finger solenoid 58 is used to engage a safety wedge and lock the lifting carriage in place and prevent slippage during a system failure or unsafe condition. The wedge finger solenoid 58 must be engaged to release the wedge finger when lowering the lifting carriage. Diversion box 62 is a connection point for the information sent on the coiled cord which connects the sensors and switches (load cell, upper limit switch, lower limit switch, post locking solenoid, motion encoder).

The HBP control system, consist of two units, the HBP communication controller (HBP1) and the Curtis 1230 Motor Controller. These two devices provide all coordination between multiple lifts and the motor to control direction, speed and safety of the lifting apparatus.

The HBP1 provides coordination between lifts using multiple ring protocols on a RS422 Token Ring interface. Various bits of information are used to provide speed adjustment, direction and mode. The HBP1 also provide for safety of the system with a "constant current" safety ring that monitors the continuous path between all lifts. The safety ring consists of MCU controlled relays on each lift, the E-Stop buttons, and motor over temperature sensors. It will inhibit movement, up or down, if any of these are open or if a wire is broken. Furthermore there is a separate signal sent between the lifts to indicate that a button is pressed which is used to power on the lifts, and to enable movement. Without the three agreeing signals the lifts will not move.

The Curtis 1230 motor controller is an AC induction motor speed controller, designed for use in a variety of material handling vehicles. This device converts the 24VDC into 3 phase AC voltage to operate the AC induction motor. The 1230 has a built in main contactor to provide overview safety and a brake controller with regenerative braking and hard braking ability. A throttle control for speed adjustment and up and down controls are connected to the HBP1 to select speed and direction. A rotary motor encoder that directly interfaces to the motor for precise speed control and error detection. The 1230 also has stall and Internal reverse polarity protection built in. Furthermore, fault detection circuitry on throttle inputs are used to inhibit operation if throttle signal goes out of range for any reason, such as a broke wire or failed part.

A front panel display 70 is operatively connected with circuitry of the lifting system in accordance with the present disclosure. The front panel display 70 is used to display various setting and features including, but not limited to, display weight, height, error messages and operation mode. Further, the lifting system can include a variety of buttons and controls to control movement and modes of the lift system.

When operating the system in accordance with the present disclosure, an operator will press a power ON button to begin operating the lifting system. Typically, pressing either the UP or DOWN button on any lifting system being used. The operator must then release the button to enable operation. All lifting systems being used will communicate with each other to verify that all are powered on. If not, the local audio will alarm and the safety relay will be set. After 2 minutes of inactivity the lifts will power down.

In an exemplary embodiment, the system can operate in two modes, single mode and multi mode. The lifting system will seldom be operated in a single mode, however, single mode can be used for testing, fine adjustment of the lift height, or correction from a fault condition. In single mode the lifting system will only operate itself and not the other lifting systems being used. The lifting system will not respond to other lifting systems being used and other lift systems being used will be inhibited unless they are put into single mode themselves, otherwise it will operate exactly as if multi mode. When in single mode the lifting system will isolate itself button-wise, from the other lifting systems being used.

Multi mode is the standard operation mode of the lifting system in accordance with the present disclosure. The lifting carriage will go up when any up button in the system is pressed and down when any down button in the system is pressed. The front panel display will show current weight being reported by the local load cell or height as selected. If a fault occurs, the front panel display 70 will show the appropriate error message. Weight can be displayed in 100 pound or 100 kilogram increments. Height can be displayed in inches or centimeter increments. Generally, there will be a method to override all safety systems and allow the lift to be moved on a limited basis.

In an exemplary embodiment, the lifting system has three systems that must coordinate to allow a safe operation. The SAFETY system is a ring that must be closed (connected) at all times in order for the lifting system to move. This ring is based on current flow. If this system is not closed, nothing moves. The MOVE ENABLE system operates with the front panel. If any UP or DOWN button is pressed on any front panel in the system a MOVE ENABLE signal is generated. This is a 100% hardware system and overrides commands from a microprocessor to prevent improper movement of any lifting system. The TOKEN Ring operates between lifts and continuously is transmitting and receiving RS422 digital data to coordinate lift operation. This data contains, but is not limited to, height, speed, direction and other information.

It is also envisioned that the lifting system according to the present disclosure also includes a power down feature to save battery power. After 2 minutes of no operation the lift will turn itself off. Pressing one of the UP or DOWN buttons in the system will power the lifting system back up, releasing the button will enable the system so the next time the button is pressed the lift will move.

The lifting system can also have mechanisms to determine several conditions that indicate unsafe operations. These faults are to be corrected before the lift is to be used. These conditions include, but are not limited to, overweight, lifting carriage speed limits exceeded, lifting system speed limits exceeded, motor temperature exceeded and lower limit switch stuck. An overweight fault means that the weight reported by the load cell indicates the lifting system is lifting more than what is acceptable for it. Once detected, the lifting system will stop, an alarm will sound on the post reporting the error and the weight will flash in the display window. All upward movement will be inhibited. The operator must press a down button in the system for the fault to clear. The lifting system will not move until the overweight condition is cleared. This error will produce 5 beeps to aid the operator in locating the lifting system in fault. A fault when the lifting carriage speed limit is exceeded will be indicated when the lifting carriage is moving too fast, too slow, or not at all when the up or down button is pressed. This is determined by reading the mode detect switch and communications with the other lifting systems being used and comparing the known acceptable values to what is being received from the encoder. Once detected, the system will first try to adjust the speed and if it cannot, it will inhibit the use of the lifting system. The user will have to reset the system. If the carriage speed limit exceeded down fault is triggered, the carriage is moving too fast, too slow, or not at all in the downward direction. This could be caused by a carriage nut separation or a locking ramp stuck. Once detected, the lifting system will attempt to adjust speed, if it cannot, it will inhibit the use of the lifting system. This error will produce a noise to aid the operator in locating the lifting system in fault. The lower limit switch stuck fault indicates when the lower limit switch is stuck when the lift is moving up at least 1 inch and the switch has not cleared. Once detected, all lifting systems being used cannot be moved until cleared. The operator clears this fault by closing the lower limit switch. The motor temperature exceeded fault indicates when a temperature that is too high is detected. All lifts will stop until the signal clears. The display will show "Ot" and the alarm will provide 5 beeps. A further fault, motor turning wrong way, will signal when the encoder is detected moving the wrong way from the button press. Once determined all lifting systems being used will stop and the entire system will have to be reset.

The lifting system according to the present disclosure includes a microprocessor system. The microprocessor has a unique role to fulfill in this system. The system cannot operate without the microprocessor running, the microprocessor is used to determine the functionality of the lifting system, such as, overweight, over temperature, speed fault, position error, and carriage nut separation. The microprocessor must also maintain constant communications with the other lifting systems being used and keep track of the height of the lifting system with respect to the other lifting systems being used. The microprocessor will utilize a token ring communication method to do this.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A regenerative braking lifting system comprising:

a base configured for mobility, at least one wheel rotatably coupled to the base;

an upstanding post that is operatively connected to the base;

a lifting carriage that is slidably coupled to the upstanding post;

a housing operatively connected to the lifting system, wherein the housing comprises at least one battery, a charger, and a circuitry of the lifting system; and a motor operatively connected to the housing, wherein rotational force of the motor generates electricity to feed back to the battery.

2. The lifting system according to claim 1 wherein the motor is a three phase induction motor used to drive a worm screw.

3. The lifting system according to claim 1 wherein the lifting system further comprises an AC three phase 24V motor and a geared transmission operatively connected to a worm screw.

4. The lifting system of claim 1 wherein the lifting system further comprises a mechanism that indicates unsafe operations.

5. The mechanism according to claim 4 wherein the unsafe operation is selected from at least one or more of the following: overweight luggage, excessive speed limit of the lifting system, excessive speed limit of the lifting carriage, excessive temperature of the motor, and sticking of the lower limit switch.

6. The lifting system of claim 1 wherein the lifting system further comprises a microprocessor that determines the functionality of the lifting system and communicates with other lifting systems being utilized.

7. A method of operating a lifting system by means of a regenerative braking system comprising:

utilizing a lifting system that includes a base configured for mobility, at least one wheel rotatably coupled to the base, an upstanding post that is operatively connected to the base, a lifting carriage that is slidably coupled to the upstanding post, a housing operatively connected to the lifting system, wherein the housing comprises at least one battery, a charger, and a circuitry of the lifting system, and a motor operatively connected to the housing, wherein rotational force of the motor generates electricity to feed back to the battery;

operating the lifting carriage in an upward direction, wherein the battery drives the motor to move the lifting arm upwardly; and operating the lifting carriage in a downward direction, wherein the motor rotates by means of mechanical force caused by the weight of a luggage on the lifting arm and wherein a rotational force generates electric feedback to the battery of the lifting system.

8. The method according to claim 7 wherein the lifting system operates in a single mode system.

9. The method according to claim 7 wherein the lifting system operates in a multi mode system.

* * * * *